US006797972B2

(12) United States Patent
Kamoshida et al.

(10) Patent No.: US 6,797,972 B2
(45) Date of Patent: Sep. 28, 2004

(54) NEUTRON SHIELDING MATERIALS AND A CASK FOR SPENT FUEL

(75) Inventors: Mamoru Kamoshida, Hitachi (JP); Masashi Oda, Hitachi (JP); Takashi Nishi, Hitachinaka (JP); Kiminori Iga, Hitachi (JP); Masashi Shimizu, Hitachi (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 10/235,644

(22) Filed: Sep. 6, 2002

(65) Prior Publication Data

US 2003/0102445 A1 Jun. 5, 2003

(30) Foreign Application Priority Data

Nov. 30, 2001 (JP) ..... 2001-365496

(51) Int. Cl.[7] ..... G21F 3/00

(52) U.S. Cl. ..... 250/507.1; 252/478; 523/445; 264/109

(58) Field of Search ..... 250/507.1, 518.1, 250/515.1, 517.1; 252/478; 523/445; 264/109, 120

(56) References Cited

U.S. PATENT DOCUMENTS

| | | | | |
|---|---|---|---|---|
| 2,961,415 A | | 11/1960 | Axelrad | |
| 3,133,887 A | * | 5/1964 | Alliegro et al. | 252/478 |
| 3,247,131 A | | 4/1966 | Bliss et al. | |
| 4,287,145 A | * | 9/1981 | McMurtry et al. | 264/109 |
| 4,313,973 A | * | 2/1982 | McMurtry et al. | 427/205 |
| 4,783,309 A | | 11/1988 | Popp et al. | |
| 6,166,390 A | * | 12/2000 | Quapp et al. | 250/506.1 |
| 6,517,743 B2 | * | 2/2003 | Anayama et al. | 252/478 |

FOREIGN PATENT DOCUMENTS

| | | |
|---|---|---|
| EP | 0 628 968 A1 | 12/1994 |
| GB | 2 163 084 A | 2/1986 |
| JP | 60233154 | 11/1985 |
| JP | 03025398 | 2/1991 |
| JP | 6-148388 | 5/1994 |
| JP | 6-180388 | 6/1994 |

* cited by examiner

*Primary Examiner*—John R. Lee
*Assistant Examiner*—Zia R. Hashmi
(74) *Attorney, Agent, or Firm*—Dickstein Shapiro Morin & Oshinsky LLP

(57) ABSTRACT

A high-polymer neutron shielding material which scarcely reduces the hydrogen number density when exposed to a high temperature of 150 to 200° C. for a long time period A heat-setting type epoxy resin is employed. The base resin is selected from various epoxy resins such as bisphenol A type epoxy resin. The hardener is selected from alicyclic polyamine, polyamide amine, aromatic polyamine, acid anhydride, and so on. These materials are mixed and hardened at a temperature higher than the room temperature. To give a flame resistance to the hardened resin, a fire retardant such as magnesium hydroxide is added to the mixture. To improve the neutron shielding performance of the hardened resin, a neutron absorbing material is added to the mixture. Further, to increase the moderating performance, hydrogenated bisphenol A epoxy resin is used as the base resin or metal hydride or hydrogen absorbing alloy is added. The present neutron shielding material works as a significant neutron shielding material as its hydrogen number density does not go down for a long time under a high-temperature condition and the neutron shielding performance does not go down.

20 Claims, 3 Drawing Sheets

NEUTRON SHIELDING MATERIALS AND A CASK FOR SPENT FUEL

BACKGROUND OF THE INVENTION

1. Field of the Invention

The present invention relates to a neutron shielding material and more particularly to a neutron shielding material which is preferably applicable to radiation shielding parts such as reactor vessels, radioactive material treating facilities such as a nuclear fuel reprocessing facility, a spent fuel storing facility, and an accelerator facility, a cask for transporting radioactive materials, and a cask for storing radioactive materials.

2. Description of the Prior Art

Spent fuel assembly are taken out from an atomic reactor, stored in water-cooled pools at the atomic power plant site for a preset time period to attenuate radiation dose and calorific power, and then transported to a processing facility such as a fuel reprocessing factory and the like. Recently in countries outside Japan, the spent nuclear fuel assembly are transported to a centralized storage facility (dry storage facility) and stored there. A radioactive storing shell called a metal cask is used to carry the spent nuclear fuel assembly from the atomic power plant site to such a facility and store there.

A metal cask consists of an outer shell which forms the container, an inner shell having heat-transferable fins made of high heat-conductivity metal plates such as copper or aluminum spaced on the outer periphery of the inner shell, and a metallic basket placed inside the inner shell. The space between the outer and inner shells is filled with a hardened resin which works as a neutron shielding material. The inner shell having an opening on the top is made of carbon steel and can shield gamma rays. The metallic basket has a plurality of cells each of which is designed to store a spent fuel aggregate. One metallic basket can store a total of 30 to 70 spent fuel assembly. The opening of the inner shell is closed with a primary lid to prevent leakage of radioactive materials and a secondary lid which is placed over the primary lid.

The resin working as a neutron shielding material is a material containing a lot of hydrogen atoms, that is a material having a high hydrogen number density. Among various kinds of high polymer compounds, the metal casks usually employ epoxy resins because the relationship of heat resistance and hydrogen number density is well balanced. In this case, the resin is a homogeneous mixture of base liquid epoxy resin, amine type hardener, aluminum hydroxide which gives flame resistance to the resin, and boron carbide which works as a neutron absorbing material. This liquid resin is poured into the space surrounded by the inner shell, the outer shell and the heat-transferable fins and hardened there at room temperature.

Below will be explained neutron shielding materials using thermo-setting resins such as epoxy resin which are applied to other than metal casks. Japanese Application Patent Laid-open Publications No. 06-148388 discloses a neutron shielding material which is obtained by mixing a multifunctional epoxy resin, a poly-amine mixture, and an imidazole compound, and reacting thereof to harden at room temperature. Japanese Application Patent Laid-open Publications No. Hei 06-180388 discloses a neutron shielding material which is hardened under pressure and heating with a phenol resin as a binder.

It has been discussed whether dry storage of spent fuel in and outside the nuclear power plant site is available for loose storage of spent fuel assembly in the water-cooled pools. In future, dry storage will be available for spent fuel assembly which are not stored so long in the water-cooled pools and further for high-burnup fuel assembly (45 GWd/ton). Such fuel assembly have great calorific power due to decays of fission-produced nuclides and transuranic elements. When the number of spent fuel assembly to be stored in such a metal cask increases, the neutron shielding material will have a greater thermal load as its thermal conductivity is smaller than that of metals.

SUMMARY OF THE INVENTION

It is an object of the present invention to provide a neutron shielding material which can be available at a higher temperature.

The above object of the present invention can be attained by constructing a neutron shielding material with the hardened material prepared by mixing a base resin which contains a compound including two or more epoxy groups in the molecule as at least one component with a hardener for opening said epoxy rings and polymerizing thereof at a temperature higher than room temperature.

Even when the neutron shielding material of the present invention is kept at 150° C. to 200° C., its neutron shielding performance will not go down as the hydrogen number density of the neutron shielding material has a very little rate of reduction at such a high temperature. The spent fuel storing shell employing the neutron shielding material of the present invention can store more spent fuel assembly which are stored for a short period in a water-cooled pool or high-burnup fuel assembly.

Another object of the present invention can be attained by constructing a neutron shielding material with the hardened material prepared by mixing a base resin which is prepared by mixing a base resin which contains a compound including two or more epoxy groups in the molecule as at least one component with a hardener for opening said epoxy rings and polymerizing thereof, wherein the setting temperature is higher than room temperature.

We inventors cleared up the problems involved in storing spent fuel assembly which are stored for a short period in a water-cooled pool or high-burnup fuel assembly in metal casks and discussed measures to solve the problems. The result of the discussion will be explained in detail below.

The spent fuel assembly which are stored for a short period in a water-cooled pool or high-burnup spent fuel assembly generate high calorific power due to decays of fission products and transuranic elements. We found "the temperature of the neutron shielding material in the metal cask goes up to 150° C. to 200° C. when a lot of assembly are stored in a single metal cask."

When heated up, the neutron shielding material having a high-polymer compound as its main component becomes oxidized and deteriorated by heat and oxygen or gradually decomposed by radioactive rays such as gamma rays and neutrons and loses hydrogen atoms. As the result, the neutron shielding material gradually loses its neutron shielding performance. The rate of losing hydrogen atoms goes greater as the temperature becomes higher. For long-term storage of spent fuel assembly which are stored for a short period in a water-cooled pool and high-burnup spent fuel assembly (which are also called high exothermic spent fuel assembly) at a high temperature densely in a metal cask, a neutron shielding material must be developed which loses hydrogen atoms so slowly and does not lose the neutron shielding performance for a preset time period at high temperature. It is possible to suppress the radiation dose low on the surface of the metal cask if the hydrogen atom losing rate of the neutron shielding material is below the decaying rate of the neutron-emitting nuclides in the spent fuel assembly. Judging from these, one of measures in densely storing high exothermic spent fuel assembly is to produce neutron shielding material by using a high-polymer compound which has a high hydrogen number density and is reluctant to lose hydrogen atoms under high-temperature conditions.

We inventors have made various discussions, studies and researches to realize neutron shielding materials which are slow to lose hydrogen atoms at 150° C. to 200° C. and developed by mainly using epoxy resins because the epoxy resins have good heat resistance, neutron-shielding performance, and dimensional stability of molded products. The term "epoxy resin" here mainly means so-called 2-component hardening type epoxy resin. The 2-component hardening type epoxy resin comprises a base epoxy resin having two or more epoxy groups in the molecule and a hardening agent which is used together to harden. The epoxy resins are classified into three (room-temperature setting type, medium-temperature setting type, and high-temperature setting type) according to setting conditions. Medium- and high-temperature setting types are sometime called heat-setting epoxy resins. This classification is dependent upon combinations of base resin and hardener. As a rough example, a bisphenol A type epoxy resin is hardened by an aliphatic polyamine type hardener at room temperature. Similarly, the bisphenol A type epoxy resin is hardened by alicyclic polyamine and polyamide amine type hardeners respectively at room and medium temperatures. To harden the bisphenol A type epoxy resins at a high temperature, aromatic polyamine type hardeners and acid anhydride are used. The medium-temperature setting type epoxy resins are the epoxy resins whose primary setting temperature is loosely in 40° C. to 80° C. and the high-temperature setting type epoxy resins are the epoxy resins whose primary setting temperature is 80° C. or higher.

In general, it is well known that the hardened resin product can have higher heat resistance as the setting temperature goes higher. In other words, the high-temperature setting type resins are more heat resistant than the medium-temperature setting type resins when they are hardened. Similarly, the medium-temperature setting type resins are more heat resistant than the room-temperature setting type resins. The "heat resistance" here is used to determine a high temperature limit allowable for the resin in respect to the mechanical strength, using a glass-transition temperature or a heat distortion temperature as the index. Contrarily, the thermal resistance index specific to neutron shielding materials is not such an index that is related to the mechanical strength, but related to the rate at which the hydrogen number density reduces and approximately to the rate at which the weight reduces by heat. We inventors hardened base epoxy resins under various conditions and evaluated the rates of resins (heat resistance) at which the weight reduces by heat, considering that the resins are applicable to neutron shielding materials. As the result, we discovered that the resins which are hardened at higher temperature have slower weight reduction rates.

As shown in FIG. 1, the hardened resin prepared by hardening bisphenol A type epoxy resin with an aromatic amine or acid anhydride at a high temperature has slower weight reduction rates (at 200° C.) than the hardened resin prepared by hardening bisphenol A type epoxy resin with an aliphatic polyamine or polyamideamine hardener at room temperature. Similarly, the hardened resin prepared by hardening bisphenol A type epoxy resin with an alicyclic amine at a high temperature explicitly has slower weight reduction rates than the hardened resin prepared by hardening bisphenol A type epoxy resin with an alicyclic amine at room temperature. Further, we hardened non-bisphenol A epoxy resins (e.g. bisphenol F, phenol novolac, and glycidyl amine type epoxy resins) with acid anhydride at a high temperature and found that their weight reduction rates due to heat could be extremely smaller as shown in FIG. 2. Judging from these test results, we inventors have concluded that medium- and high-temperature setting type epoxy resins can be applied as neutron shielding materials to be used in high-temperature environments.

As the analytic result of elementary compositions of said hardened epoxy resins, we found "the hydrogen number densities of the hardened epoxy resins in combination with acid anhydride or aromatic amine at high temperature are usually lower than those of the epoxy resins hardened at room temperature." Also in such a case, the neutron shielding material comprising the above hardened epoxy resin can have a required neutron shielding performance by increasing its thickness. However, we have found that we need not increase the thickness of the neutron shielding material (or increase the thickness just a little) if we take some measures to increase its hydrogen number density. The first measure to increase the hydrogen number density of epoxy resins without destroying the high heat resistance is substituting the bisphenol A base epoxy resin by alicyclic glycidyl ether or the like which contains more hydrogen atoms and hardening thereof at a high temperature. To increase the hydrogen number density of the hardened epoxy resins, the second measure is to add metal hydride such as titanium hydride when the epoxy resins are in combination with acid anhydride or aromatic amine as a hardener. In case alicyclic amine is used as a hardener, the hydrogen number density of the hardened epoxy resin can be increased much more when metallic hydride is added. The third measure is to substitute part of acid anhydride (when the acid anhydride is used as a hardener) by an amine type hardener whose quantity to the base resin can be less. This increases the rate of amine type hardener in the base resin having a high hydrogen content and consequently increases the hydrogen number density of the hardened resin. The present invention contains any of the above measures to increase the hydrogen number densities of the hardened epoxy resins. The heat-setting epoxy resins scarcely lose the neutron shielding performance for a long time period as they are high heat resistant and slow to lose hydrogen atoms. Particularly, the first, second, or third measure can suppress the thickness of the neutron shielding material whose hydrogen number density is low.

Judging from the empirical rule that the heat-setting type epoxy resins which are superior in heat resistance have a lower hydrogen number density, it had been assumed that the measure of using alicyclic glycidyl ether as the base resin might reduce the heat resistance of the resin. However, our test results have told that, when the normal bisphenol A epoxy resin is substituted partially or wholly by alicyclic di-glycidyl ether, the weight reducing rate of the hardened resin at 200° C. is extremely low if the resin is heat-hardened by acid anhydride. From this test result, we inventors hit on an idea that a high heat-resistant neutron shielding material having an excellent neutron shielding performance can be produced from alicyclic di-glycidyl ether. It has been well-known that adding metal hydride to room-temperature type epoxy resin for neutron shielding increase the hydrogen number density effectively. However, when metal hydride is added to a heat-setting type epoxy resin (not a room-temperature setting type epoxy resin) to be used as a neutron shielding material, a peculiar problem occurs. Under a heated setting condition, metal hydride and a hardener such as acid anhydride react very quickly and the reactant may lose hydrogen atoms easily. As for this problem, we inventors added metal hydride to the mixture of heat-setting type epoxy resin and a hardener to be hardened and evaluated the reaction. As the result, we found "metal hydride reacts with neither hardener nor base resin." Judging from this test result, we hit on an idea that we can increase the hydrogen number density of the heat-setting type epoxy resin by adding metal hydride to the epoxy resin.

It sometimes happens that hydrate of metal oxide is added as a fire retardant to the epoxy resin to give flame resistance to the epoxy resin to be used as neutron shielding material. For example, a neutron shielding material used in a metal cask is an example of neutron shielding material including a fire retardant. Usually, hydrated aluminum usually known as alumina trihydrate is added to the room-temperature setting type epoxy resin. When heat-setting epoxy resins are applied as neutron shielding materials, it is peculiar that water must be removed from the fire retardant while the epoxy resin is heated and hardened. However, this dehydration of the fire retardant will reduce the hydrogen number density of the neutron shielding material and consequently this leads to a reduction in the neutron shielding performance of the epoxy resin. The epoxy resin is sometimes heated up to about 200° C. while setting is in progress because the neutron shielding material of the present invention is assumed to be used mainly under a temperature condition of 150° C. to 200° C. In other words, any fire retardant that starts to dehydrate below 200° C. may not be available to the heat-setting type epoxy resins. Therefore, we must clarify a standard for selecting fire retardants.

In general, it has been known that alumina trihydrate starts dehydration at about 200° C. This temperature is evaluated by the differential thermal calorimetry and thermogravimetric analysis that heats up comparatively slowly at a rate of a few degrees per minute for measurement. However, after our more careful and exact differential thermal calorimetry and thermogravimetric analysis, we found that alumina trihydrate already started dehydration at about 170° C. at a significant rate. Therefore, in some cases, alumina trihydrate cannot be applied to the heat-setting epoxy resins. Similarly, it has been known that magnesium hydroxide starts dehydration at about 310° C. However, after our more careful and exact analysis, we found that magnesium hydroxide started dehydration at about 290° C. at a significant rate. This dehydration starting temperature is fully higher than the maximum hardening temperature (about 290° C.) of heat-setting epoxy resins and magnesium hydroxide can scarcely dehydrate at actual hardening temperature. To ascertain this, we inventors kept magnesium hydroxide at 200° C. for 200 hours and measured its weight reduction rate. The weight reduction rate was 0.1% or less. Judging from the above, any of alumina trihydrate and magnesium hydroxide can be added as a fire retardant to a heat-setting type epoxy resin for neutron shielding which is hardened at medium temperature in combination with an alicyclic polyamine or polyamide amine hardener. When the epoxy resin is hardened by an aromatic amine or acid anhydride hardener at a maximum hardening temperature (about 200° C.), a preferable fire retardant is magnesium hydroxide. This is our explicit standard for selecting fire retardants. By the way, magnesium hydroxide dehydrates vigorously at about 350° C. Some room-temperature setting epoxy resins thermally decompose at lower temperatures. However, magnesium hydroxide cannot function as a fire retardant for such epoxy resins if the epoxy resins may be heated up to 300° C. Contrarily, almost all heat-setting type epoxy resins thermally decompose at about 350° C. Therefore, we can say magnesium hydroxide is the most preferable fire retardant for the heat-setting type epoxy resins. Additionally, if a little dehydration is allowed in the heat-setting process or if the thickness of the neutron shielding material is determined in advance to make up for the loss by dehydration, alumina trihydrate can be added to the high-temperature setting epoxy resins. We inventors also found that it is possible to add phosphor compound and halide type fire retardants (which have been widely used as fire retardants in general industrial fields) to heat-setting epoxy resins to be used for neutron shielding judging from the discussions similar to those on magnesium hydroxide. As explained above, we inventors can clarify a standard for selecting fire retardants available to heat-setting epoxy resins to be used for neutron shielding materials from our results of tests on fire retardants.

Neutron shielding materials made of heat-resistant high-polymer materials can contain a neutron absorbing material such as a boron compound which has a great neutron-absorbing sectional area. The typical example is the neutron shielding material used in a metal cask. For this purpose, boron carbide is added to room-temperature setting type epoxy resins. When heat-setting epoxy resins are applied as neutron shielding materials, it is peculiar that the neutron-absorbing component (e.g. boron carbide and boron nitride) may react with components of the heat-setting epoxy resin such as base resin, hardener such as acid anhydride, and fire retardant such as magnesium hydroxide at high temperature. Experimentally, we inventors have ascertained that boron carbide and boron nitride do not react with components of the heat-setting epoxy resin such as base resin, hardener such as acid anhydride, and fire retardant such as magnesium hydroxide at high temperature. From the above discussion, we inventors hit on an idea that we can improve the neutron shielding performance of the neutron shielding material made of a heat-setting epoxy resin without losing the characteristics of the hardened material by adding a boron compound such as boron carbide and boron nitride as the neutron absorbing material to the epoxy resin. For the similar reason, non-boron compounds such as gadolinium oxide and samarium oxide are also available as neutron absorbing materials.

As apprarent from the above explanation, the present invention has been made from our own profound experiments and evaluations which clarify that the heat-setting epoxy resins can be applied as neutron shielding materials.

The base resin is preferably a member selected from the group of bisphenol A epoxy compound, novolak epoxy compound, alicyclic glycidyl ether type epoxy compound, various glycidyl ester type epoxy compound, glycidyl amine type epoxy compound, and biphenol type epoxy compound or a mixture thereof.

The hardener is preferably a member selected from the group of amine type hardener such as aromatic amine, alicyclic amine, and polyamide amine, acid anhydrate type hardener, and imidazole type hardening promoter or a mixture thereof. Below will be explained the quantity of respective hardeners to be added to the base resin. If the equivalent ratio of epoxy groups in the base resin to active hydrogen atoms in the hardener is not 0.7 to 1.3, excessive base resin or hardener may be left in the hardened resin. As both the base resin and the hardener have vapor pressures, the excessive base resin or hardener will evaporate when heated up. This causes a loss of hydrogen atoms in the hardened resin. Therefore, the equivalent ratio of epoxy groups in the base resin to active hydrogen atoms in the hardener should be 0.7 to 1.3 and more preferably about 1.0 to make the hardened resin has a low weight reduction rate due to heat.

The fire retardant is preferably a member selected from the group consisting of metal hydroxide such as magnesium hydroxide, aluminum hydroxide, and calcium hydroxide, hydrates of said metal oxide, inorganic phosphoric compounds such as ammonium phosphate, organic phosphoric compounds such as phosphoric ester, and halogenated compounds such as hexabromo benzene and tetrabromobisphenol A or a mixture thereof. As the hardened resin contains more fire retardant, the hardened resin can be more fire-resistant but reversely the hardened resin has less hydrogen number density and becomes more viscous. To give a high shielding performance, fire resistance and workability to the hardened resin in a well-balanced manner, the ratio of the fire retardant should be 30% to 60% by weight.

The neutron absorbing materials are preferably isotopes having a high thermal neutron absorbing sectional area and more preferably boron compounds such as boron carbide and boron nitride, cadmium compounds such as cadmium oxide, gadolinium compounds such as gadolinium oxide, and samarium compounds such as samarium oxide. However in general, these compounds are very expensive, the minimum ratio of addition can be determined from the neutron absorbing performance and maximum ratio of addition can be determined from the cost of the neutron shielding material. From our cost and performance estimation, the preferable ratio of the neutron-absorbing material is 0.1% to 10% by weight to get a neutron shielding material having a balanced relationship of shielding cost and performance.

Preferale metal hydrides are titanium hydride and preferable hydrogen-absorbing alloys are magnesium-nickel alloy.

The neutron shielding material of the present invention is hard to lose the neutron shielding performance even when exposed to a high temperature of 150 to 200° C. and has the neutron shielding ability improved in that temperature range.

DESCRIPTION OF THE PREFERRED EMBODIMENTS (Embodiment 1)

Figure 1:
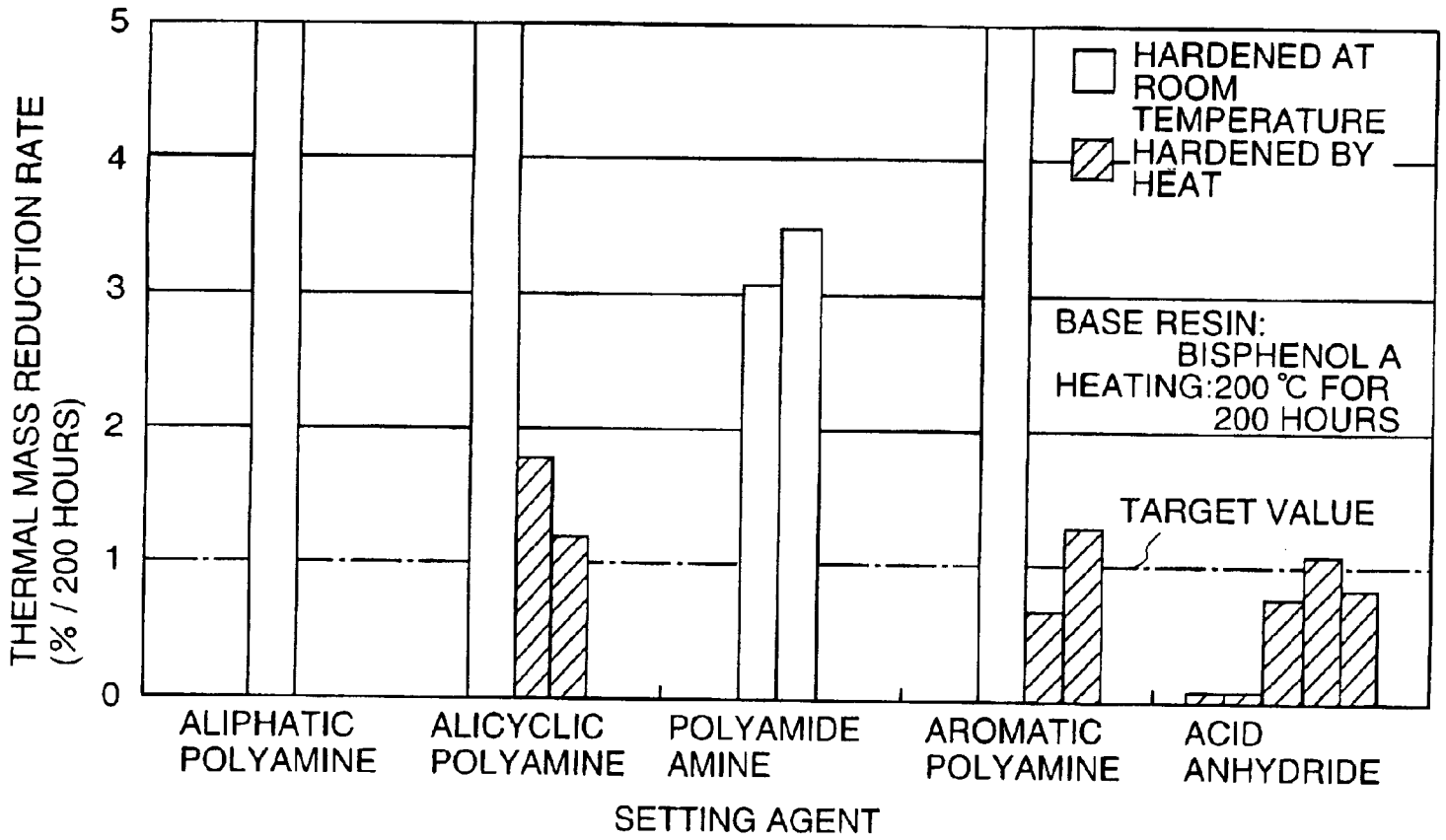
FIG. 1 illustrates an experimental thermal weight reduction rates of bisphenol A epoxy resins hardened by various hardeners.
Figure 2:
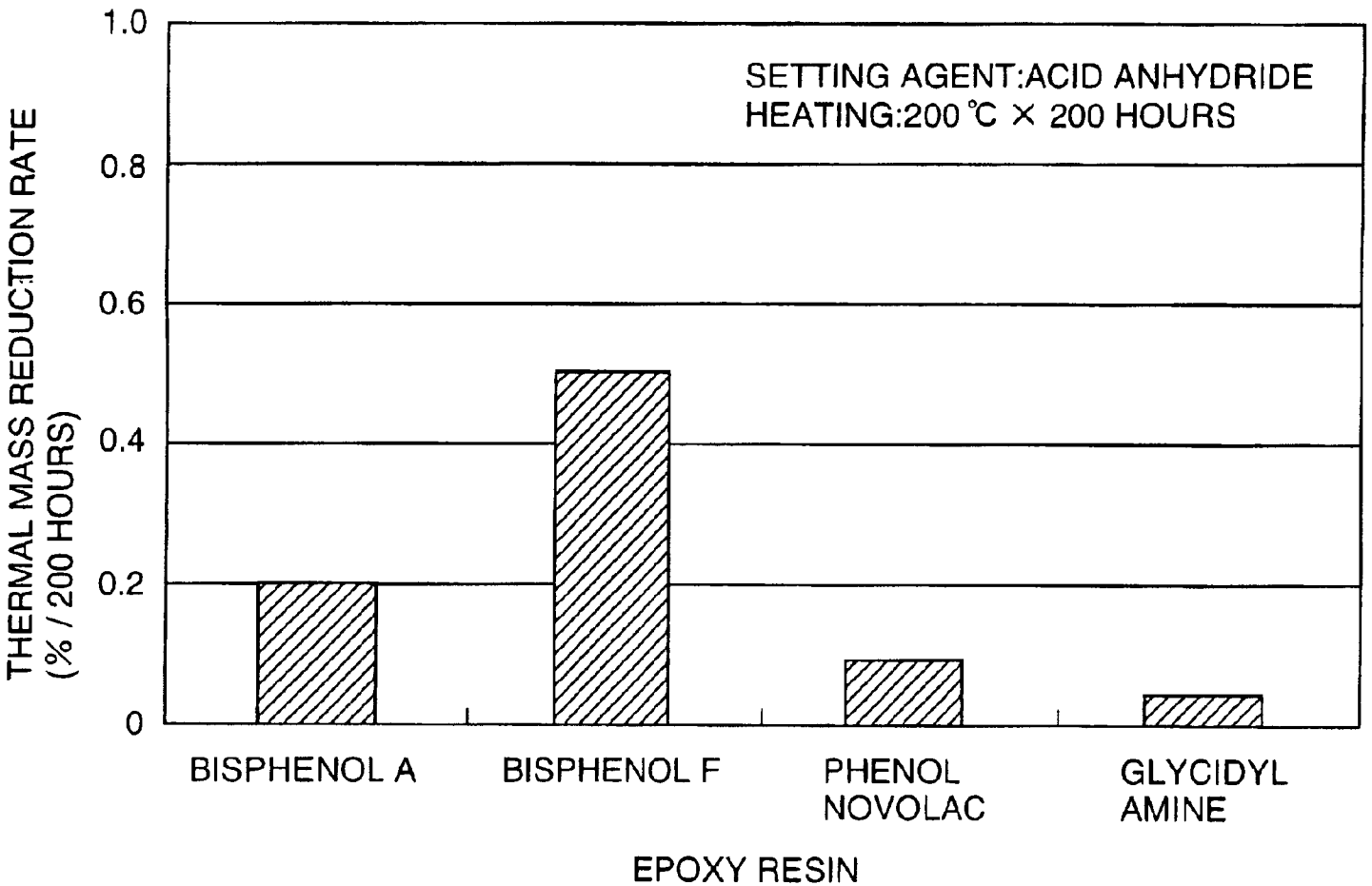
FIG. 2 illustrates an experimental thermal weight reduction rates of various epoxy resins hardened by an acid anhydride hardener.
Figure 3:
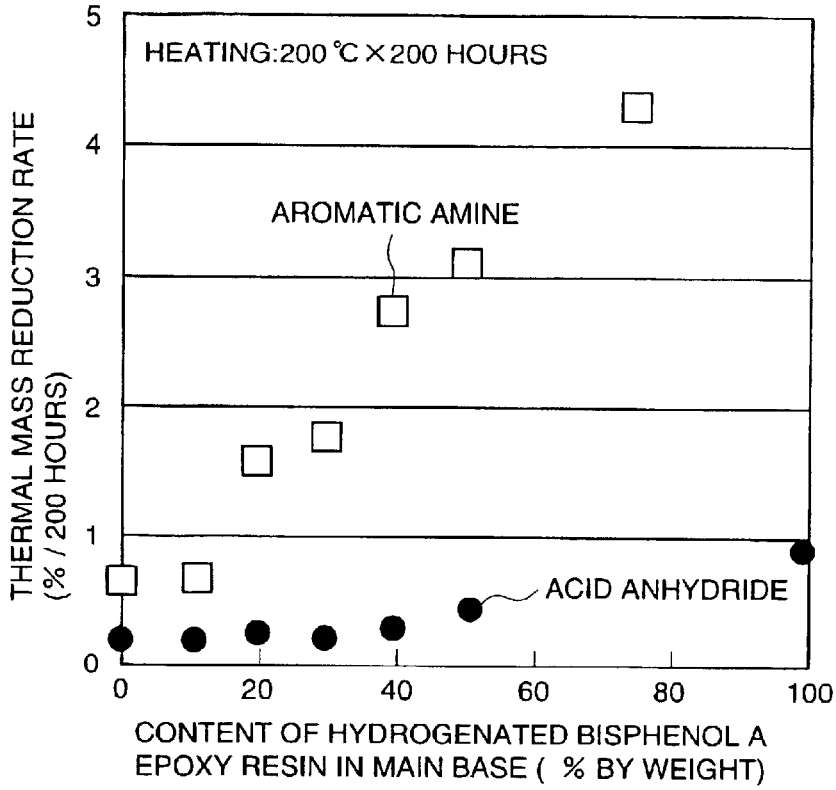
FIG. 3 illustrates an experimental thermal weight reduction rates of base resin mixtures of bisphenol A epoxy resin and hydrogenated bisphenol A epoxy resin at various ratios hardened by hardeners.

Among combinations of bisphenol A epoxy resin and various hardeners, the resin product prepared by heat-hardening bisphenol A epoxy resin in combination with acid anhydride and aromatic amine or the like features a low thermal weight reduction rate, excellent heat resistance, and a low hydrogen number density, which is already explained referring to FIG. 1. Alicyclic di-glycidyl ether type epoxy resin is used as the base resin to increase the hydrogen number density without reducing the heat resistance thereof. We inventors prepared base resins by mixing bisphenol A epoxy resin and alicyclic di-glycidyl ether epoxy resin at various ratios, heat-hardened them by acid anhydride or aromatic amine, and evaluated their weight reduction rates at 200° C. FIG. 3 shows the result of the experiment. In this experiment, we used bisphenol A epoxy resin having epoxy equivalent of 180 to 190 grams/equivalent and viscosity of about 100 dPa.s at room temperature as the bisphenol A epoxy resin, and commercially-available hydrogenated bisphenol A epoxy resin having epoxy equivalent of about 240 grams/equivalent and viscosity of about 35 dPa.s at room temperature as the alicyclic di-glycidyl ether type epoxy resin. Further we used a mixture of methylcyclopentadiene to which maleic anhydride is added and a small amount of imidazole as an acid anhydride type hardener, and methylene di-aniline as an aromatic amine type hardener.

When the aromatic amine hardener is used to harden the epoxy resin, the thermal weight reduction rate becomes greater as the hydrogenated bisphenol A epoxy resin occupies more in the base resin. Contrarily, when the acid anhydride hardener is used, the thermal weight reduction rate of the hardened resin is low even when the base resin is all hydrogenated bisphenol A epoxy resin (100%). Further as the content of the hydrogenated bisphenol A epoxy resin increases in the base resin, the hardened resin has higher hydrogen number density and higher neutron shielding performance. On the basis of the above experimental knowledge, this embodiment explains a neutron shielding material comprising a hardened resin prepared by hardening the hydrogenated bisphenol A epoxy resin by acid anhydride. The neutron shielding material of this embodiment is prepared with the base resin, a hardener, and a hardening promoter which are already described above. The neutron shielding material of this embodiment is prepared in the procedure below.

This embodiment uses hydrogenated bisphenol A epoxy resin whose epoxy equivalent is about 240 grams/equivalent as the base resin. We prepared a mixture of 100 parts by weight of base resin, about 65 parts by weight of acid anhydride hardener such as methylcyclopentadiene to which maleic anhydride is added, 0.1 to 2 parts by weight of 2-ethyl 4-methyl imidazole as a hardening promoter, 130 to 200 parts by weight of magnesium hydroxide whose mean grain size (of primary particles) is 1 to 2 $\mu$m as a fire retardant, and about 3 parts by weight of boron carbide powder whose mean grain size is 100 $\mu$m. This mixture was fully mixed up at a constant temperature of 70 to 100° C. and poured into a preheated die. Initially, the mixture was heated at about 80 to 130° C. for 2 to 4 hours for primary hardening, then at about 140 to 170° C. for 4 to 12 hours for secondary hardening, at about 200° C. for a short time period if necessary, and cooled the mixture gradually. We used this hardened resin as a neutron shielding material.

The above neutron shielding material of this embodiment will not reduce the neutron shielding performance even when the neutron shielding material is exposed to high temperature of 150 to 200° C. for a long time period.

Figure 4:
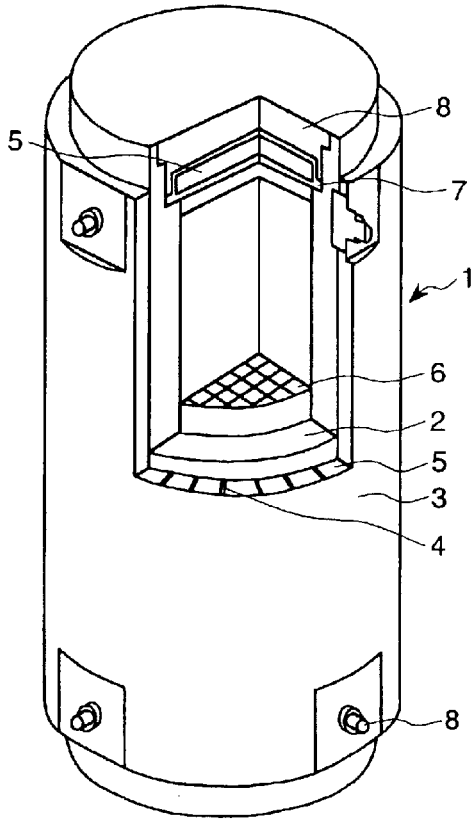
FIG. 4 illustrates the configuration of a metal cask employing the neutron shielding material of Embodiment 1.

Referring to FIG. 4, a metal cask will be explained below which employs the neutron shielding material of this embodiment. A metal cask 1 consists of an outer shell (outer shell) which forms the container, an inner shell 2 having heat-conductive aluminum fins 4 spaced on the outer periphery of the inner shell 2 (inner shell), and a grid-like metallic basket 6 placed inside the inner shell. The neutron absorbing material 5 prepared by this embodiment is filled in the space between the outer shell 3 and the inner shell 2 which is partitioned by the heat-conductive fins 4. The inner shell having an opening on the top is made of carbon steel and can shield gamma rays. The metallic basket 6 has a plurality of cells each of which is designed to store a spent fuel aggregate. The opening of the inner shell 2 is closed with a primary lid 7 to prevent leakage of radioactive materials and a secondary lid 8 which is placed over the primary lid. The inner space of the primary lid 7 is also filled with the neutron absorbing material 5. In case the metallic basket 6 in the metal cask 1 stores 70 spent fuel assembly which are stored for a short period in a water-cooled pool or high-burnup fuel assembly, the temperature of the neutron shielding material 5 goes up to 150 to 200° C. due to the heat emitted from the fuel assembly. However, in this case, the neutron shielding performance of the metal cask 1 does not go down because the neutron shielding material 5 keeps the neutron absorbing performance even when it is exposed to a high temperature of 150 to 200° C. for a long time period. As explained above, the metal cask 1 can store about 60 or more spent fuel assembly which are short-stored in a water-cooled pool or high-burnup fuel assembly. The neutron shielding material of this embodiment is also applicable to shield the high temperature areas of 150 to 200° C. in the radioactive material treating facilities such as reactor vessels, nuclear fuel reprocessing facilities, spent fuel storing facilities, and accelerator facilities. The embodiments 2 to 5 below are also applicable to such radioactive material treating facilities.

The base epoxy resin can be hydrogenated bisphenol A epoxy resin singly or together with bisphenol A epoxy resin. Further the epoxy resin to be mixed therewith can be bisphenol A epoxy resin, bisphenol F epoxy resin, or novolac type epoxy resin such as phenol novolac epoxy resin and cresol novolac epoxy resin. The glycidyl ether type epoxy resin can be substituted by glycidyl ester type epoxy resin, glycidyl amine type epoxy resin, biphenyl type epoxy resin, or naphthalene type epoxy resin. Further, the hydrogenated bisphenol A type epoxy resin can be substituted by any epoxy compound such as alicyclic epoxy compound having more hydrogen atoms in the molecule. Any combination of base resin and hardener is selectable as long as the base resin and the hardener are fit for heat-hardening and the hardened resin contains hydrogen atoms of $5\times10^{22}$ atoms/$cm^3$ or more.

For explanation, this embodiment uses methylcyclopentadiene to which maleic anhydride is added as a hardener, but it can be substituted by any known acid anhydride hardener selected from the group of phthalic anhydride, maleic anhydride, methyl nadic anhydride, succinic anhydride, pyromellitic anhydride, chlorendic anhydride, and modification thereof, or a mixture thereof. If it is possible to take much time for hardening, the hardening promoter such as imidazole type hardener or the like need not be added.

Although this embodiment uses magnesium hydroxide as a fire retardant, the fire retardant need not be added if the neutron shielding material is applied to what does not require flame resistance. To prepare a neutron shielding material which does not want the reduction in the hydrogen number density during heat-hardening aluminum hydroxide can be used instead of magnesium hydroxide. Calcium hydroxide, hydro garnet and the like can be used as a fire retardant. In the above description, the quantity of magnesium hydroxide to be added is determined according to the viscosity, the mixing time, and effect of flame resistance assuming that the resin mixture is mixed up at about 80° C. However unless the viscosity of the mixture exceeds a maximum of 200 grams/eq.s, the quantity of magnesium hydroxide to be added can be changed according to the viscosity and the mixing temperature. Similarly, it is also possible to determine the quantity of magnesium hydroxide to be added from a point of view that the viscosity is 200 grams/eq.s or less for at least one hour or longer. Further, it is possible to determine the quantity of a fire retardant to be added from a point of view that the oxygen index of the hardened resin exceeds 20.

Any other boron compounds such as boron nitride than boron carbide can be added to the neutron absorbing material. Further, the neutron absorbing material can be omitted for some special applications. The boron compounds can be substituted by cadmium oxide, gadolinium oxide, and samarium oxide.

(Embodiment 2)

This embodiment uses, as a neutron shielding material, a heat-setting epoxy resin prepared by hardening alicyclic di-glycidyl ether type epoxy resin as the base resin by a mixture of acid anhydride and amine hardeners.

This embodiment as well as Embodiment 1 uses hydrogenated bisphenol A epoxy resin as the alicyclic di-glycidyl ether type epoxy resin. Methylcyclopentadiene to which maleic anhydride is added is used as an acid anhydride hardener as well as in Embodiment 1. This embodiment uses a mixture of alicyclic polyamine and methylcyclopentadiene to which maleic anhydride is added as a hardener and an imidazole compound as the hardening promoter. As well as Embodiment 1, this embodiment uses magnesium hydroxide as the fire retardant and boron carbide as the neutron absorbing material.

When acid anhydride is used singly as the hardener, the ratio of acid anhydride to the base resin is determined by a stoichiometric relationship between the equivalent of base epoxy resin and the equivalent of acid anhydride. The content of hydrogen atoms in the acid anhydride is comparatively small. Therefore, it is assumed that the acid anhydride, when used singly as the hardener, works to dilute the hydrogen atoms in the base resin. Accordingly, this embodiment reduces the quantity of acid anhydride to be added to the base resin and add an amine type hardener to make up for it. The quantity of the amine hardener to harden a predetermined quantity of the base resin is generally half to one third of the quantity of the acid anhydride hardener to harden the base resin. Therefore, we can increase the ratio of the base resin relative to the whole resin by substituting part of the acid anhydride hardener by the amine type hardener. This can also increase the hydrogen number density of the hardened resin. This embodiment describes an example of compounding ratio which reacts about 30% of the whole epoxy resin groups in the base resin with the amine type hardener and the remainder with the acid anhydride hardener. The compounding ratio is 100 parts by weight of hydrogenated bisphenol A epoxy resin as the base resin, 45 parts by weight of acid anhydride as part of the hardener, about 8 parts by weight of alicyclic polyamine, about 150 parts by weight of magnesium hydroxide as the fir retardant, and about 3 parts by weight of boron carbide as the neutron absorbing material. This mixture was fully mixed up at about 80° C. and poured into a die. The mixture was heated and hardened in the same manner as Embodiment 1. We used this hardened resin as a neutron shielding material.

The neutron shielding material of this embodiment which has been prepared as explained above does not lose the neutron shielding performance even when it is exposed to a high temperature of 150 to 200° C. for a long time period. The neutron shielding material of this embodiment can have higher hydrogen number density than that of Embodiment 1. The metal cask employing the neutron shielding material of this embodiment uses the neutron absorbing material 5 (of FIG. 4) of the neutron shielding material of this embodiment. The metal cask 1 employing the neutron shielding material of this embodiment can store about 60 or more spent fuel assembly which are short-stored in a water-cooled pool or high-burnup fuel assembly.

This embodiment as well as neutron shielding material 1 can substitute the base resin, the anhydride, the fire retardant, and the neutron shielding material by the other materials. Any publicly-known alicyclic polyamine compound can be used as a hardener as long as it can be used for heat-setting.

(Embodiment 3)

This embodiment uses, as a neutron shielding material, a heat-setting epoxy resin prepared by hardening a base resin by acid anhydride or the like and adding hydrogenated titanium thereto.

This embodiment uses bisphenol A epoxy resin as the base resin and acid anhydride as a hardener. To complete the hardening reaction within about one day, a hardening promoter such as imidazole is added to the resin mixture. Further, to this mixture are added magnesium hydroxide as the fire retardant, boron carbide as the neutron absorbing material, and halogenated titanium. Their ratios by weight in the mixture are about 30% of magnesium hydroxide, about 3% or less boron carbide, 20% to 30% of halogenated titanium, and the remainder of bisphenol A epoxy resin. This mixture was fully mixed up at 80° C. and poured into a die. The mixture was heated and hardened in the same manner as Embodiment 1. We used this hardened resin as a neutron shielding material.

The base resin can be bisphenol A epoxy resin, its modification, and various novolac epoxy resins such as glycidyl ether type epoxy resin, glycidyl ester type epoxy resin, glycidyl amine type epoxy resin, and biphenol type epoxy resin or a mixture thereof with alicyclic di-glycidyl ether type epoxy resin. Besides acid anhydride, the hardener can be any kind of publicly-known amine type hardener for heat-setting resins.

The fire retardant and the neutron absorbing material can be substituted as well as in Embodiment 1. Hydrogenated titanium can be substituted by a hydrogen-absorbing alloy such as magnesium and nickel alloy.

The neutron shielding material of this embodiment which has been prepared as explained above does not lose the neutron shielding performance even when it is exposed to a high temperature of 150 to 200° C. for a long time period. The neutron shielding material of this embodiment can have higher hydrogen number density than that of Embodiment 1. In other words, this embodiment can provide a neutron shielding material which does not lose the neutron shielding performance even when it is exposed to a high temperature for a long time. Further, as this embodiment uses a metal hydride to increase the hydrogen number density of the neutron shielding material, the neutron shielding material can have excellent heat resistance and neutron shielding performance. The metal cask employing the neutron shielding material of this embodiment uses the neutron absorbing material 5 (of FIG. 4) of the neutron shielding material of this embodiment. The metal cask 1 employing the neutron shielding material of this embodiment can store about 60 or more spent fuel assembly which are short-stored in a water-cooled pool or high-burnup fuel assembly.

(Embodiment 4)

As seen from FIG. 3, for the use of an aromatic amine hardener, when the rate of hydrogenated bisphenol A epoxy resin increases in the base resin (which is a mixture of bisphenol A epoxy resin and hydrogenated bisphenol A epoxy resin), the hydrogen number density of the hardened resin increases but the thermal weight reduction rate becomes greater. However, as long as hydrogenated bisphenol A epoxy resin is up to 50% by weight of the whole base resin, the hardened resin is fully available under a high temperature condition of 150° C. or higher. This embodiment explains an example of using, as a neutron shielding material, a heat-setting epoxy resin prepared by hardening a mixture of bisphenol A epoxy resin and hydrogenated bisphenol A epoxy resin as the base resin by an aromatic amine hardener This embodiment uses the same materials as those used for FIG. 3 tests. The materials are bisphenol A epoxy resin having epoxy equivalent of about 180 to 190 grams/equivalent and hydrogenated bisphenol A epoxy resin having epoxy equivalent of about 240 grams/equivalent as the base resin, and methylene di-aniline compound as the aromatic amine hardener.

The base resin of this embodiment is a mixture of 50 parts by weight of bisphenol A epoxy resin and 50 parts by weight of hydrogenated bisphenol A epoxy resin. To this base resin are added about 30 parts by weight of aromatic amine, 100 to 160 parts by weight of magnesium hydroxide as a fire retardant, and about 3 parts by weight of boron carbide. This mixture was fully mixed up at a constant temperature in the range of 70 to 100° C. and poured the homogeneous mixture liquid into a die. The mixture in the die was heated at 80 to 120° C. for about 2 hours for primary hardening, then heated at 120 to 180° C. for about 4 to 12 hours for secondary hardening, heated to about 200° C. for a comparatively short time for final hardening if necessary, and then cooled. We used this hardened resin as a neutron shielding material.

The neutron shielding material of this embodiment which has been prepared as explained above does not lose the neutron shielding performance even when it is exposed to a high temperature of 150 to 200° C. for a long time period. The metal cask employing the neutron shielding material of this embodiment uses the neutron absorbing material 5 (of FIG. 4) of the neutron shielding material of this embodiment. The metal cask 1 employing the neutron shielding material of this embodiment can store about 60 or more spent fuel assembly which are short-stored in a water-cooled pool or high-burnup fuel assembly.

Epoxy resins to be combined with hydrogenated bisphenol A epoxy resin as the base resin can be bisphenol A epoxy resin and other epoxy resins such as novolac epoxy resin listed in Embodiment 1. The hydrogenated bisphenol A epoxy resin can be substituted by any epoxy compound such as alicyclic epoxy which contains a lot of hydrogen atoms in the molecule. Base resins and hardeners can be determined from a point of view that the hydrogen number density of the hardened resin is $5\times10^{22}$ atoms/cm$^3$.

Any publicly-known alicyclic polyamine compound can be used as a hardener as long as it can be used for heat-setting. Further the fire retardant and the neutron absorbing material can be substituted by other substances as well as in Embodiment 1.

(Embodiment 5)

This embodiment explains a neutron shielding material prepared by hardening bisphenol A epoxy resin singly by an alicyclic polyamine hardener. The epoxy resin mixture comprises 100 parts by weight of bisphenol A epoxy resin as the base resin, about 30 parts by weight of alicyclic polyamine, 150 to 200 parts by weight of alumina trihydrate, and 3 parts by weight of boron carbide powder. This mixture was fully mixed up at room temperature to make it uniform. This liquid resin mixture was poured into a die, left at room temperature for one day or longer or preferably about 7 days to harden it, heated up to 180 to 200° C. for secondary hardening, heated to 180 to 200° C. for a comparatively short time for final hardening, and then cooled. It is also possible to gradually increase the primary hardening temperature from about 40° C. to about 90° C. and proceed to secondary hardening under the above condition.

The above hardened resin is placed outside the inner shell of the metal cask.

The neutron shielding material of this embodiment which has been prepared as explained above does not lose the neutron shielding performance even when it is exposed to a high temperature of 150 to 200° C. for a long time period. The metal cask employing the neutron shielding material of this embodiment uses the neutron absorbing material 5 (of FIG. 4) of the neutron shielding material of this embodiment. The metal cask 1 employing the neutron shielding material of this embodiment can increase the number of spent fuel assembly which are short-stored in a water-cooled pool or high-burnup fuel assembly. In summary, this embodiment can provide a neutron shielding material whose shielding performance does not go down even when it is exposed to a high temperature for a long time. The primary hardening of the mixture at room temperature can lessen the thermal load in application. Further this embodiment enables secondary hardening in the execution of a heat transfer test.

The base resin can be substituted by any of glycidyl ether type epoxy resin, glycidyl ester type epoxy resin, glycidyl amine type epoxy resin, and biphenyl type epoxy resin. For easier handling, the bisphenol A epoxy resin can be made less viscous by reducing the degree of cross-linking, by a proper diluting agent, or by a type modified to reduce the viscosity. It is possible to obtain a hardened resin of high hydrogen number density by using a hydrogen-rich epoxy compound such as alicyclic di-glycidyl ether type epoxy resin singly or in combination with various epoxy resin such as bisphenol A epoxy resin. In any case, the epoxy resin can be heat-hardened into a neutron shielding material whose neutron shielding performance doe not go down for a long time period.

The fire retardant and the neutron absorbing material of this embodiment can be changed as well as in Embodiment 1.

What is claimed is:

1. A neutron shielding material containing epoxy resin as one of main component, comprising a hardened material which is prepared by mixing a base resin which contains a compound including two or more epoxy groups in the molecule as at least one component with a hardener for opening said epoxy rings and polymerizing thereof by heat setting said base resin at a temperature higher than room temperature.

2. A neutron shielding material containing epoxy resin as one of main component, comprising a hardened material which is prepared by mixing a base resin which contains a compound including two or more epoxy groups in the molecule as at least one component with a hardener for opening said epoxy rings and polymerizing thereof, wherein the setting temperature is approximately 40° C. or higher.

3. A neutron shielding material according to claim 1 or 2, wherein said base resin is a member selected from the group of bisphenol A epoxy compound, novolak epoxy compound, alicyclic glycidyl ether type epoxy compound, various glycidyl ester type epoxy compound, glycidyl amine type epoxy compound, and biphenol type epoxy compound or a mixture thereof, and said hardener is a member selected from the group of amine type hardener such as aromatic amine, alicyclic amine, and polyamide amine, acid anhydrate type hardener, and imidazole type hardening promoter or a mixture thereof.

4. A neutron shielding material according to claim 3, wherein hardened material contains a fire retardant that said base resin contains.

5. A neutron shielding material according to claim 4, wherein said fire retardant contains a member selected from the group consisting of metal hydroxide such as magnesium hydroxide, aluminum hydroxide, and calcium hydroxide, hydrates of said metal oxide, inorganic phosphoric compounds such as ammonium phosphate, organic phosphoric compounds such as phosphoric ester, and halogenated compounds such as hexabromo benzene and tetrabromobisphenol A.

6. A neutron shielding material according to claim 5, wherein said hardened material contains a neutron absorbing material that is added to said base resin.

7. A neutron shielding material according to claim 6, wherein said neutron absorbing material contains a member selected from the group consisting of boric compounds, cadmium compounds, gadolinium compounds, and samarium compounds.

8. A neutron shielding material according to claim 7, wherein said hardened material contains a metal hydride or a hydrogen-absorbing alloy that is added to said base resin.

9. A neutron shielding material according to claim 3, wherein said base resin and said hardener are so mixed that the equivalent ratio of the active hydrogen group in said amine type hardener to the epoxy group in said base resin may be 0.7 to 1.3 when the amine type hardener is used as said hardener or the equivalent ratio of the total of active hydrogen group and acid anhydride to the epoxy group in said base resin may be 0.7 to 1.3 when the amine type hardener is mixed up with the acid anhydride.

10. A neutron shielding material according to claim 5, wherein said fire retardant, if it is a metal hydroxide or hydrate of said metal oxide, is added to said base resin at a ratio of 30% to 60% by weight of said base resin.

11. A neutron shielding material according to claim 7, wherein said neutron absorbing material, if it is a boron carbide or boron nitride, is added to said base resin at a ratio of 0.1 to 10% by weight of said base resin.

12. A neutron shielding material according to claim 8, wherein the components of the neutron shielding material are mixed up so that the viscosity of the liquid mixture of said base resin and said additives may not exceed 200 dPa.s immediately after addition thereof at 30° C. to 100° C.

13. A neutron shielding material according to claim 8, wherein the components of the neutron shielding material are mixed up so that the viscosity of the liquid mixture of said base resin and said additives may not exceed 200 dPa.s at 30° C. to 100° C. for at least one hour.

14. A neutron shielding material according to claim 8, wherein the components of the neutron shielding material are mixed up so that so that the hydrogen number density of the compound of said base resin and said additives may be $5\times10^5$ hydrogen atoms/$cm^3$.

15. A neutron shielding material according to claim 5, wherein said fire retardant is mixed so that the oxygen index of said hardened material after heating may exceed 20.

16. A neutron shielding material according to claim 5, wherein the mean grain size of magnesium hydroxide is 0.5 to 5 $\mu$m when magnesium hydroxide is used as said fire retardant.

17. A neutron shielding material according to claim 8, comprising said hardened material which is obtained by reading said base resin with said additives at 30° C. to 130° C. as the first-order hardening and then reacting thereof at 130° C. to 180° C. as the second-order hardening.

18. A neutron shielding material according to claim 8, comprising said hardened material which is obtained by reacting said base resin with said additives at room temperature as the first-order hardening and then reacting thereof at 60° C. to 180° C. as the second-order hardening.

19. A spent-fuel storage cask comprising an outer shell, an inner shell provided inside said outer shell, a basket provided inside said outer shell to store spent fuel assembly, and a neutron shielding material according to claim 1 which is placed between said inner and outer shells.

20. A spent-fuel storage cask comprising an outer shell, an inner shell provided inside said outer shell, a basket provided inside said outer shell to store spent fuel assembly, and a neutron shielding material according to claim 2 which is placed between said inner and outer shells.

* * * * *